US009336655B2

(12) United States Patent
Aoki et al.

(10) Patent No.: US 9,336,655 B2
(45) Date of Patent: May 10, 2016

(54) WAGERING GAMES HAVING REDUCED MAXIMUM WAGERING LEVELS

(71) Applicant: WMS Gaming Inc., Waukegan, IL (US)

(72) Inventors: Dion K. Aoki, Chicago, IL (US); Allon G. Englman, Chicago, IL (US); Andrew C. Guinn, Chicago, IL (US); Daniel P. Louie, Chicago, IL (US); Michael W. Mastropietro, Chicago, IL (US); Jeremie D. Moll, Chicago, IL (US)

(73) Assignee: Bally Gaming, Inc., Las Vegas, NV (US)

( * ) Notice: Subject to any disclaimer, the term of this patent is extended or adjusted under 35 U.S.C. 154(b) by 85 days.

(21) Appl. No.: 13/829,980

(22) Filed: Mar. 14, 2013

(65) Prior Publication Data

US 2014/0274286 A1 Sep. 18, 2014

(51) Int. Cl.
*G07F 17/32* (2006.01)

(52) U.S. Cl.
CPC ..... *G07F 17/3267* (2013.01); *G07F 17/3244* (2013.01); *G07F 17/3255* (2013.01)

(58) Field of Classification Search
CPC ..... G07F 17/3267; G07F 17/3244; G07F 17/3255
USPC ..... 463/16–20
See application file for complete search history.

(56) References Cited

U.S. PATENT DOCUMENTS

| | | | | |
|---|---|---|---|---|
| 6,517,433 | B2 | 2/2003 | Loose et al. | |
| 7,094,149 | B2 * | 8/2006 | Walker et al. | 463/25 |
| 7,591,726 | B2 * | 9/2009 | Baerlocher et al. | 463/25 |
| 8,491,392 | B2 * | 7/2013 | Baerlocher | 463/42 |
| 8,721,433 | B2 * | 5/2014 | Walker et al. | 463/25 |
| 2003/0199312 | A1 * | 10/2003 | Walker et al. | 463/25 |
| 2004/0063492 | A1 * | 4/2004 | Baerlocher et al. | 463/25 |
| 2005/0159209 | A1 * | 7/2005 | Fiden et al. | 463/20 |
| 2006/0211477 | A1 * | 9/2006 | Walker et al. | 463/16 |
| 2006/0252482 | A1 * | 11/2006 | Walker et al. | 463/13 |
| 2008/0300051 | A1 * | 12/2008 | Walker et al. | 463/25 |
| 2009/0124351 | A1 | 5/2009 | DeWaal et al. | |
| 2009/0124373 | A1 * | 5/2009 | Acres | 463/29 |
| 2009/0124384 | A1 | 5/2009 | Smith et al. | |
| 2009/0291736 | A1 * | 11/2009 | Walker et al. | 463/20 |
| 2009/0325681 | A1 | 12/2009 | Englman et al. | |
| 2010/0069160 | A1 | 3/2010 | Barrett | |
| 2010/0094692 | A1 * | 4/2010 | Meyerhofer et al. | 705/14.12 |
| 2010/0133752 | A1 | 6/2010 | Ko | |
| 2010/0234099 | A1 | 9/2010 | Rasmussen | |
| 2011/0130188 | A1 * | 6/2011 | Walker et al. | 463/17 |
| 2012/0088575 | A1 * | 4/2012 | Walker et al. | 463/25 |
| 2012/0289322 | A1 | 11/2012 | Causley | |
| 2013/0316802 | A1 * | 11/2013 | Walker et al. | 463/25 |
| 2013/0316806 | A1 * | 11/2013 | Walker et al. | 463/25 |

* cited by examiner

*Primary Examiner* — Michael Cuff
(74) *Attorney, Agent, or Firm* — Nixon Peabody LLP

(57) ABSTRACT

A gaming system and method includes receiving a wager and in response thereto a basic game is conducted. The basic game includes a plurality of symbols that indicate a randomly selected outcome. In response to an offer trigger, an offer is displayed to conduct one or more subsequent plays of the basic game at a reduced maximum bet wager having a wager amount that is less than a normal maximum bet wager amount. A second input is received indicative of an acceptance of the offer for a reduced maximum bet wager. A randomly selected outcome is displayed. The plurality of possible outcomes each include a plurality of symbols arranged in an array. If the randomly selected outcome includes a winning symbol combination, an award is provided for any winning outcome. The provided award is determined as though a normal maximum bet wager amount was received.

20 Claims, 6 Drawing Sheets

550

WAGERING GAMES HAVING REDUCED MAXIMUM WAGERING LEVELS

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming apparatus and methods and, more particularly, to wagering games having reduced maximum wagering levels.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

SUMMARY OF THE INVENTION

According to one aspect of the present invention, a gaming system comprises one or more input devices, one or more display devices, one or more processors, and; one or more memory devices storing instructions that, when executed by the one or more processors, cause the gaming system to conduct a basic wagering game including a plurality of symbols that indicate a randomly selected outcome of the basic wagering game. In response to an occurrence of a triggering event, an offer to play one or more subsequent plays of the basic wagering game is initiated at a discounted maximum bet wager having a wager amount that is less than a non-discounted maximum bet wager. The offer is displayed on the one or more display devices. An input indicative of player acceptance of the discounted maximum bet wager offer is received, via at least one of the one or more input devices. A randomly selected outcome from a plurality of possible outcomes is displayed. The plurality of possible outcomes each include a plurality of symbols arranged in an array. If the displayed randomly selected outcome includes a winning symbol combination, an award is provided for any winning outcome. The provided award is determined as though a non-discounted maximum bet wager was received.

According to another aspect of the invention, a computer-implemented method in a gaming system comprises receiving, via at least one of one or more input devices, a first input indicative of a wager. In response to receiving the first input, a basic game is conducted via one or more processors. The basic game includes a plurality of symbols that indicate a randomly selected outcome. In response to an offer trigger, an offer is displayed on one or more display devices to conduct one or more subsequent plays of the basic game at a reduced maximum bet wager having a wager amount that is less than a normal maximum bet wager amount. A second input is received, via at least one of the one or more input devices, indicative of an acceptance of the offer for a reduced maximum bet wager. A randomly selected outcome from a plurality of possible outcomes is displayed. The plurality of possible outcomes each include a plurality of symbols arranged in an array. If the displayed randomly selected outcome includes a winning symbol combination, an award is provided for any winning outcome. The provided award is determined as though a normal maximum bet wager amount was received.

According to yet another aspect of the invention, one or more physical machine-readable storage media include instructions which, when executed by one or more processors, cause the one or more processors to perform the above methods.

Additional aspects of the invention will be apparent to those of ordinary skill in the art in view of the detailed description of various embodiments, which is made with reference to the drawings, a brief description of which is provided below.

Figure 1:
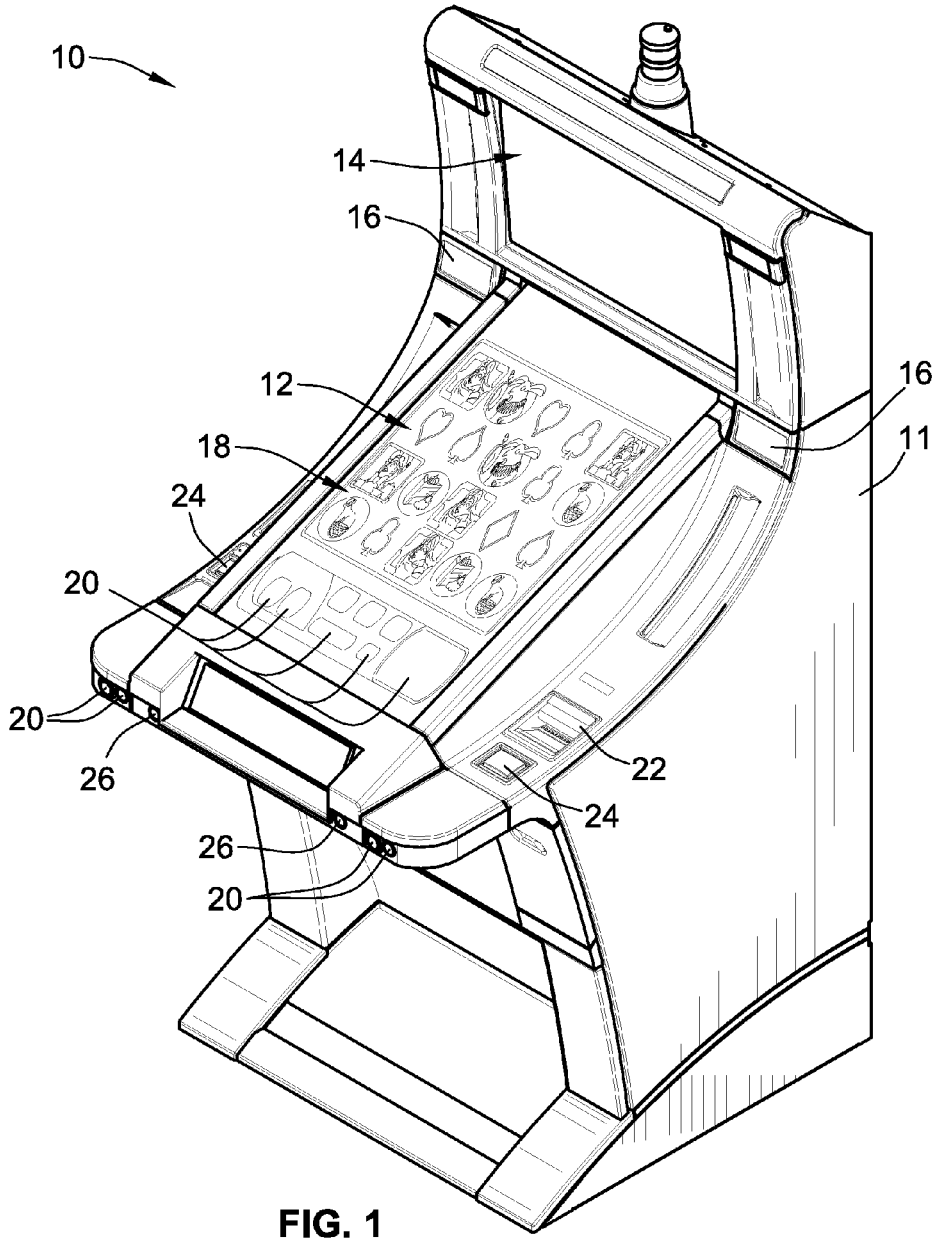
FIG. 1 is a perspective view of a free-standing gaming terminal according to an embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

Referring to FIG. 1, there is shown a gaming terminal 10 similar to those used in gaming establishments, such as casinos. With regard to the present invention, the gaming terminal 10 may be any type of gaming terminal and may have varying structures and methods of operation. For example, in some aspects, the gaming terminal 10 is an electromechanical gaming terminal configured to play mechanical slots, whereas in other aspects, the gaming terminal is an electronic gaming terminal configured to play a video casino game, such as slots, keno, poker, blackjack, roulette, craps, etc. The gaming terminal 10 may take any suitable form, such as floor-standing models as shown, handheld mobile units, bartop models, workstation-type console models, etc. Further, the gaming terminal 10 may be primarily dedicated for use in conducting wagering games, or may include non-dedicated devices, such as mobile phones, personal digital assistants, personal computers, etc. Exemplary types of gaming terminals are disclosed in U.S. Pat. No. 6,517,433, titled "Reel Spinning Slot Machine With Superimposed Video Image," U.S. Patent Application Publication Nos. US2010/0069160, titled "Handheld Wagering Game Machine And Docking Unit," and US2010/0234099, titled "Wagering Game System With Docking Stations" which are incorporated herein by reference in their entireties.

The gaming terminal 10 illustrated in FIG. 1 comprises a cabinet 11 that may house various input devices, output devices, and input/output devices. By way of example, the gaming terminal 10 includes a primary display area 12, a secondary display area 14, and one or more audio speakers 16. The primary display area 12 or the secondary display area 14 may be a mechanical-reel display, a video display, or a combination thereof in which a transmissive video display is disposed in front of the mechanical-reel display to portray a video image superimposed upon the mechanical-reel display. The display areas may variously display information associated with wagering games, non-wagering games, community games, progressives, advertisements, services, premium entertainment, text messaging, emails, alerts, announcements, broadcast information, subscription information, etc. appropriate to the particular mode(s) of operation of the gaming terminal 10. The gaming terminal 10 includes a touch screen(s) 18 mounted over the primary or secondary areas, buttons 20 on a button panel, bill validator 22, information reader/writer(s) 24, and player-accessible port(s) 26 (e.g., audio output jack for headphones, video headset jack, USB port, wireless transmitter/receiver, etc.). It should be understood that numerous other peripheral devices and other elements exist and are readily utilizable in any number of combinations to create various forms of a gaming terminal in accord with the present concepts.

Input devices, such as the touch screen 18, buttons 20, a mouse, a joystick, a gesture-sensing device, a voice-recognition device, and a virtual input device, accept player input(s) and transform the player input(s) to electronic data signals indicative of the player input(s), which correspond to an enabled feature for such input(s) at a time of activation (e.g., pressing a "Max Bet" button or soft key to indicate a player's desire to place a maximum wager to play the wagering game). The input(s), once transformed into electronic data signals, are output to a CPU for processing. The electronic data signals are selected from a group consisting essentially of an electrical current, an electrical voltage, an electrical charge, an optical signal, an optical element, a magnetic signal, and a magnetic element.

Figure 2:
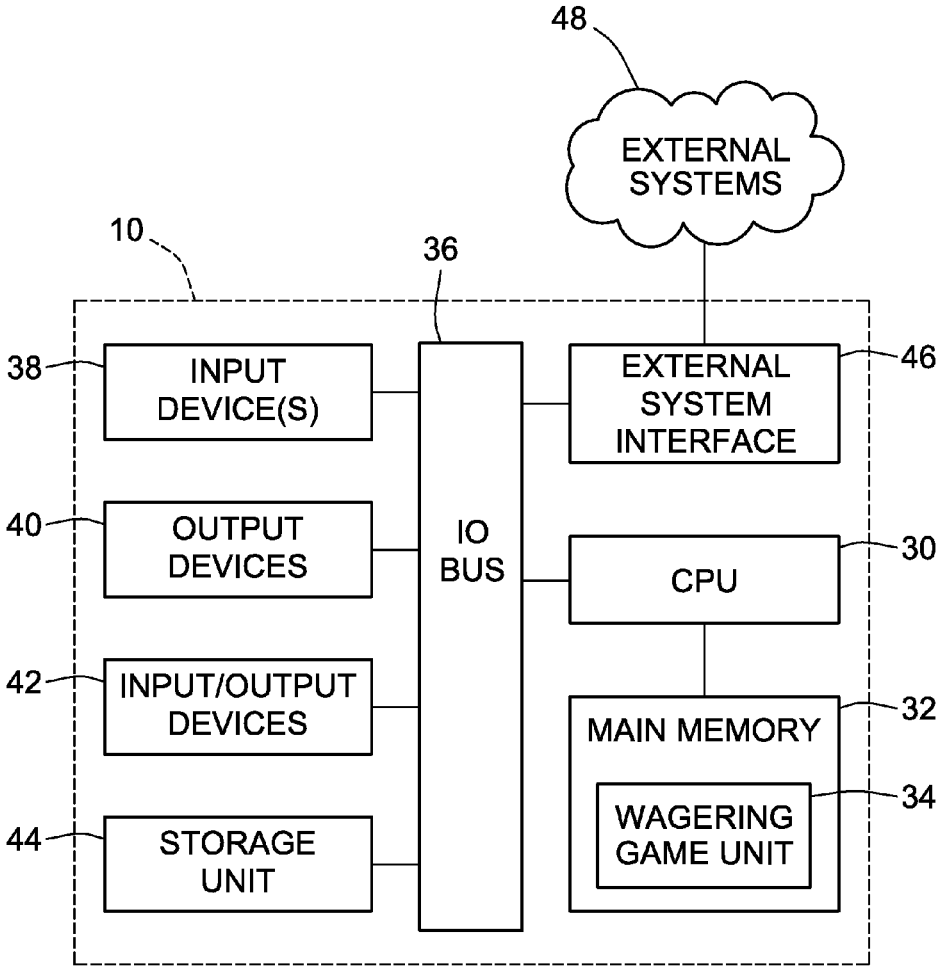
FIG. 2 (PRIOR ART)
FIG. 2 is a schematic view of a gaming system according to an embodiment of the present invention.

Turning now to FIG. 2, there is shown a block diagram of the gaming-terminal architecture. The gaming terminal 10 includes a central processing unit (CPU) 30 connected to a main memory 32. The CPU 30 may include any suitable processor(s), such as those made by Intel and AMD. By way of example, the CPU 30 includes a plurality of microprocessors including a master processor, a slave processor, and a secondary or parallel processor. CPU 30, as used herein, comprises any combination of hardware, software, or firmware disposed in or outside of the gaming terminal 10 that is configured to communicate with or control the transfer of data between the gaming terminal 10 and a bus, another computer, processor, device, service, or network. The CPU 30 comprises one or more controllers or processors and such one or more controllers or processors need not be disposed proximal to one another and may be located in different devices or in different locations. The CPU 30 is operable to execute all of the various gaming methods and other processes disclosed herein. The main memory 32 includes a wagering game unit 34. In one embodiment, the wagering game unit 34 may present wagering games, such as video poker, video black jack, video slots, video lottery, etc., in whole or part.

The CPU 30 is also connected to an input/output (I/O) bus 36, which can include any suitable bus technologies, such as an AGTL+ frontside bus and a PCI backside bus. The I/O bus 36 is connected to various input devices 38, output devices 40, and input/output devices 42 such as those discussed above in connection with FIG. 1. The I/O bus 36 is also connected to storage unit 44 and external system interface 46, which is connected to external system(s) 48 (e.g., wagering game networks).

The external system 48 includes, in various aspects, a gaming network, other gaming terminals, a gaming server, a remote controller, communications hardware, or a variety of other interfaced systems or components, in any combination. In yet other aspects, the external system 48 may comprise a player's portable electronic device (e.g., cellular phone, electronic wallet, etc.) and the external system interface 46 is configured to facilitate wireless communication and data transfer between the portable electronic device and the CPU 30, such as by a near-field communication path operating via magnetic-field induction or a frequency-hopping spread spectrum RF signals (e.g., Bluetooth, etc.).

The gaming terminal 10 optionally communicates with the external system 48 such that the terminal operates as a thin, thick, or intermediate client. In general, a wagering game includes an RNG for generating a random number, game logic for determining the outcome based on the randomly generated number, and game assets (e.g., art, sound, etc.) for presenting the determined outcome to a player in an audio-visual manner. The RNG, game logic, and game assets are contained within the gaming terminal 10 ("thick client" gaming terminal), the external system 48 ("thin client" gaming terminal), or are distributed therebetween in any suitable manner ("intermediate client" gaming terminal).

The gaming terminal 10 may include additional peripheral devices or more than one of each component shown in FIG. 2. Any component of the gaming terminal architecture may include hardware, firmware, or tangible machine-readable storage media including instructions for performing the operations described herein. Machine-readable storage media includes any mechanism that stores information and provides the information in a form readable by a machine (e.g., gaming terminal, computer, etc.). For example, machine-readable storage media includes read only memory (ROM), random access memory (RAM), magnetic disk storage media, optical storage media, flash memory, etc.

Figure 3:
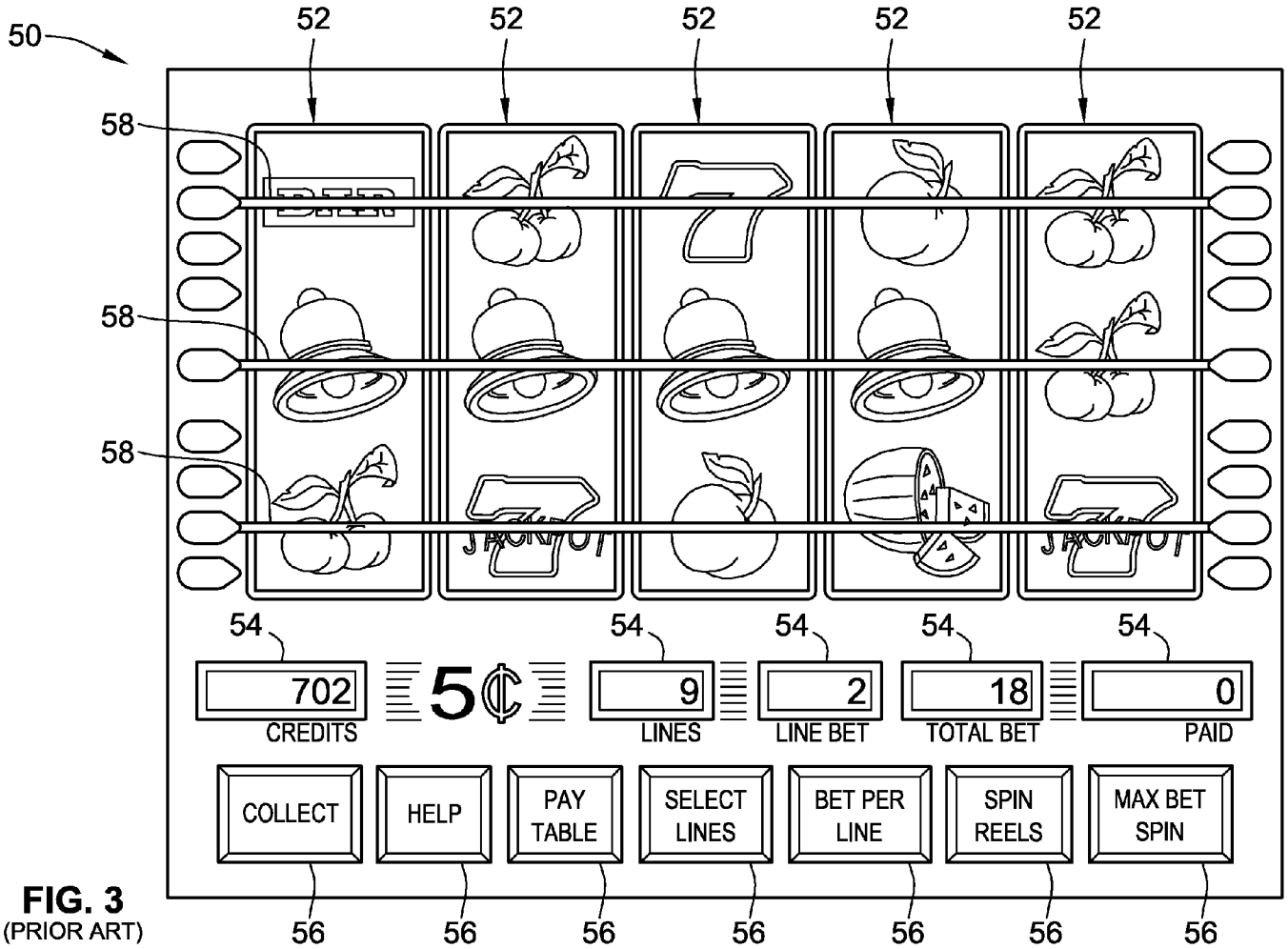
FIG. 3 (PRIOR ART)
FIG. 3 is an image of an exemplary basic-game screen of a wagering game displayed on a gaming terminal, according to an embodiment of the present invention.

Referring now to FIG. 3, there is illustrated an image of a basic-game screen 50 adapted to be displayed on the primary display area 12 or the secondary display area 14. The basic-game screen 50 portrays a plurality of simulated symbol-bearing reels 52. Alternatively or additionally, the basic-game screen 50 portrays a plurality of mechanical reels or other video or mechanical presentation consistent with the game format and theme. The basic-game screen 50 also advantageously displays one or more game-session credit meters 54 and various touch screen buttons 56 adapted to be actuated by a player. A player can operate or interact with the wagering game using these touch screen buttons or other input devices such as the buttons 20 shown in FIG. 1. The CPU operate(s) to execute a wagering game program causing the primary display area 12 or the secondary display area 14 to display the wagering game.

In response to receiving an input indicative of a wager, the reels 52 are rotated and stopped to place symbols on the reels in visual association with paylines such as paylines 58. The wagering game evaluates the displayed array of symbols on the stopped reels and provides immediate awards and bonus features in accordance with a pay table. The pay table may, for example, include "line pays" or "scatter pays." Line pays occur when a predetermined type and number of symbols appear along an activated payline, typically in a particular order such as left to right, right to left, top to bottom, bottom to top, etc. Scatter pays occur when a predetermined type and number of symbols appear anywhere in the displayed array without regard to position or paylines. Similarly, the wagering game may trigger bonus features based on one or more bonus triggering symbols appearing along an activated payline (i.e., "line trigger") or anywhere in the displayed array (i.e., "scatter trigger"). The wagering game may also provide mystery awards and features independent of the symbols appearing in the displayed array.

In accord with various methods of conducting a wagering game on a gaming system in accord with the present concepts, the wagering game includes a game sequence in which a player makes a wager and a wagering game outcome is provided or displayed in response to the wager being received or detected. The wagering game outcome is then revealed to the player in due course following initiation of the wagering game. The method comprises the acts of conducting the wagering game using a gaming apparatus, such as the gaming terminal 10 depicted in FIG. 1, following receipt of an input from the player to initiate the wagering game. The gaming terminal 10 then communicates the wagering game outcome to the player via one or more output devices (e.g., primary display 12 or secondary display 14) through the display of information such as, but not limited to, text, graphics, static images, moving images, etc., or any combination thereof. In accord with the method of conducting the wagering game, the CPU transforms a physical player input, such as a player's pressing of a "Spin Reels" touch key, into an electronic data signal indicative of an instruction relating to the wagering game (e.g., an electronic data signal bearing data on a wager amount).

In the aforementioned method, for each data signal, the CPU (e.g., CPU 30) is configured to process the electronic data signal, to interpret the data signal (e.g., data signals corresponding to a wager input), and to cause further actions associated with the interpretation of the signal in accord with computer instructions relating to such further actions executed by the controller. As one example, the CPU causes the recording of a digital representation of the wager in one or more storage media (e.g., storage unit 44), the CPU, in accord with associated computer instructions, causing the changing of a state of the storage media from a first state to a second state. This change in state is, for example, effected by changing a magnetization pattern on a magnetically coated surface of a magnetic storage media or changing a magnetic state of a ferromagnetic surface of a magneto-optical disc storage media, a change in state of transistors or capacitors in a volatile or a non-volatile semiconductor memory (e.g., DRAM), etc. The noted second state of the data storage media comprises storage in the storage media of data representing the electronic data signal from the CPU (e.g., the wager in the present example). As another example, the CPU further, in accord with the execution of the instructions relating to the wagering game, causes the primary display 12, other display device, or other output device (e.g., speakers, lights, communication device, etc.) to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of computer instructions relating to the wagering game is further conducted in accord with a random outcome (e.g., determined by a RNG) that is used by the CPU to determine the outcome of the game sequence, using a game logic for determining the outcome based on the randomly generated number. In at least some aspects, the CPU is configured to determine an outcome of the game sequence at least partially in response to the random parameter.

Figure 4:
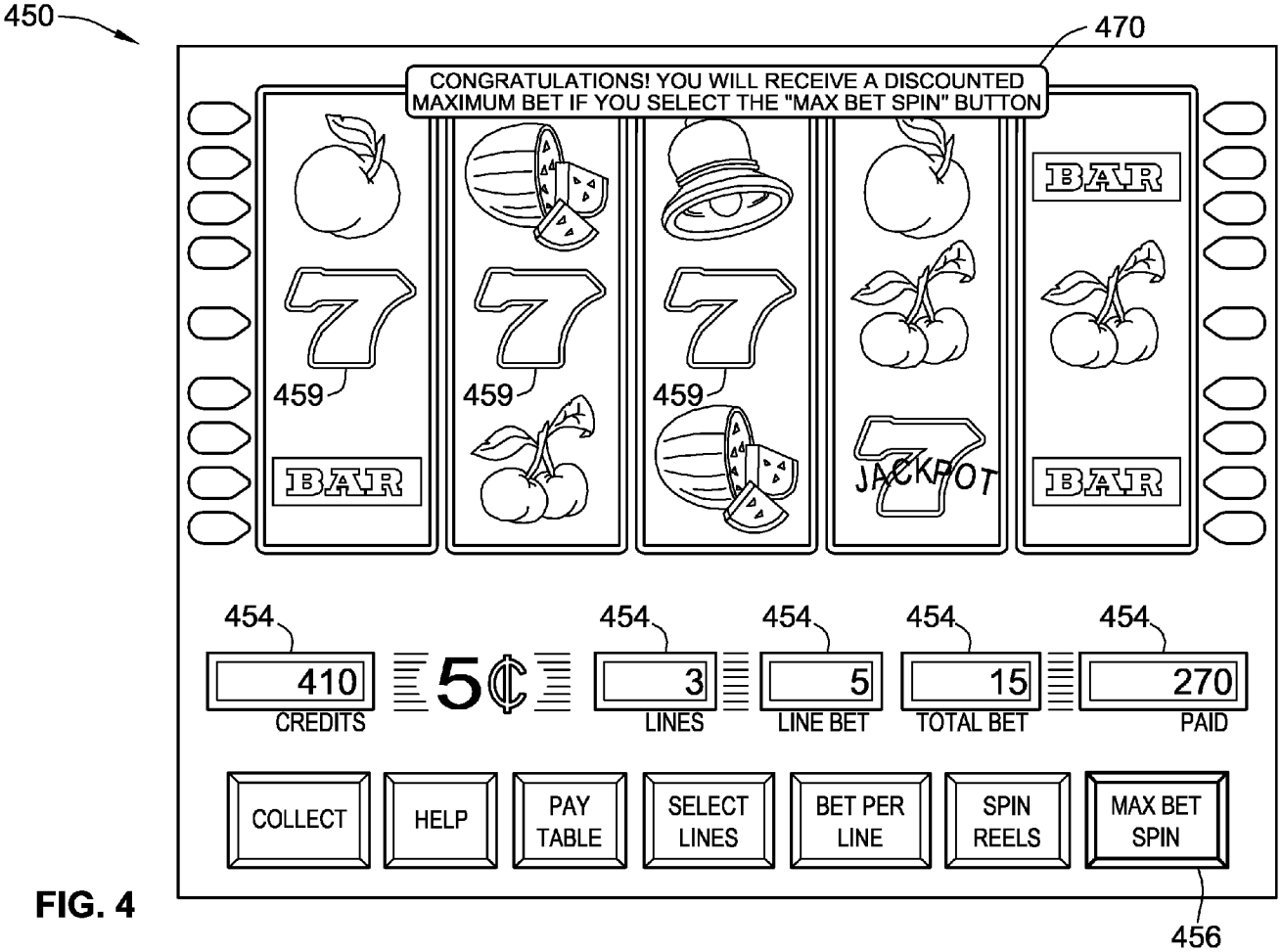
FIG. 4 is an image of an exemplary basic-game screen of a wagering game displayed on a gaming terminal, according to an embodiment of the present invention.

Referring now to FIG. 4, broad exemplary aspects of the features of a discounted maximum bet wagering game, such as a slots game, are described. A wagering interface 450 is illustrated for a basic-game screen, similar to the interface illustrated in FIG. 3. The interface 450 includes a plurality of reels, one or more game-session credit meters 454, and various touch screen buttons 456 adapted to be actuated by a player. In response to receiving an input indicative of a wager, the wagering interface 450, displays an outcome for the wagering game including a winning symbol combination (e.g., 7-7-7) comprising one or more symbols 459. For this particular exemplary reel spin, a bet was received for fewer than the maximum number of selectable paylines (e.g., 3 of 9 paylines) and the player's line bet was less than the maximum bet (e.g., 5 credits out of a maximum of 20 credits). Following the spin, the wagering game evaluates the displayed array of symbols on the stopped reels and provides immediate awards and bonus features in accordance with a pay table. If there is a triggering event for a discounted maximum bet, an offer 470 is displayed on the wagering interface in response to the trigger. The offer 470 informs the player that a discounted or reduced maximum bet will be processed if a selection of the highlighted max bet spin button 456 is received. The trigger in the example of FIG. 4 is an outcome including a predetermined winning symbol combination. However, a variety of trigger(s) are contemplated with additional exemplary aspects throughout this disclosure.

Figure 5:
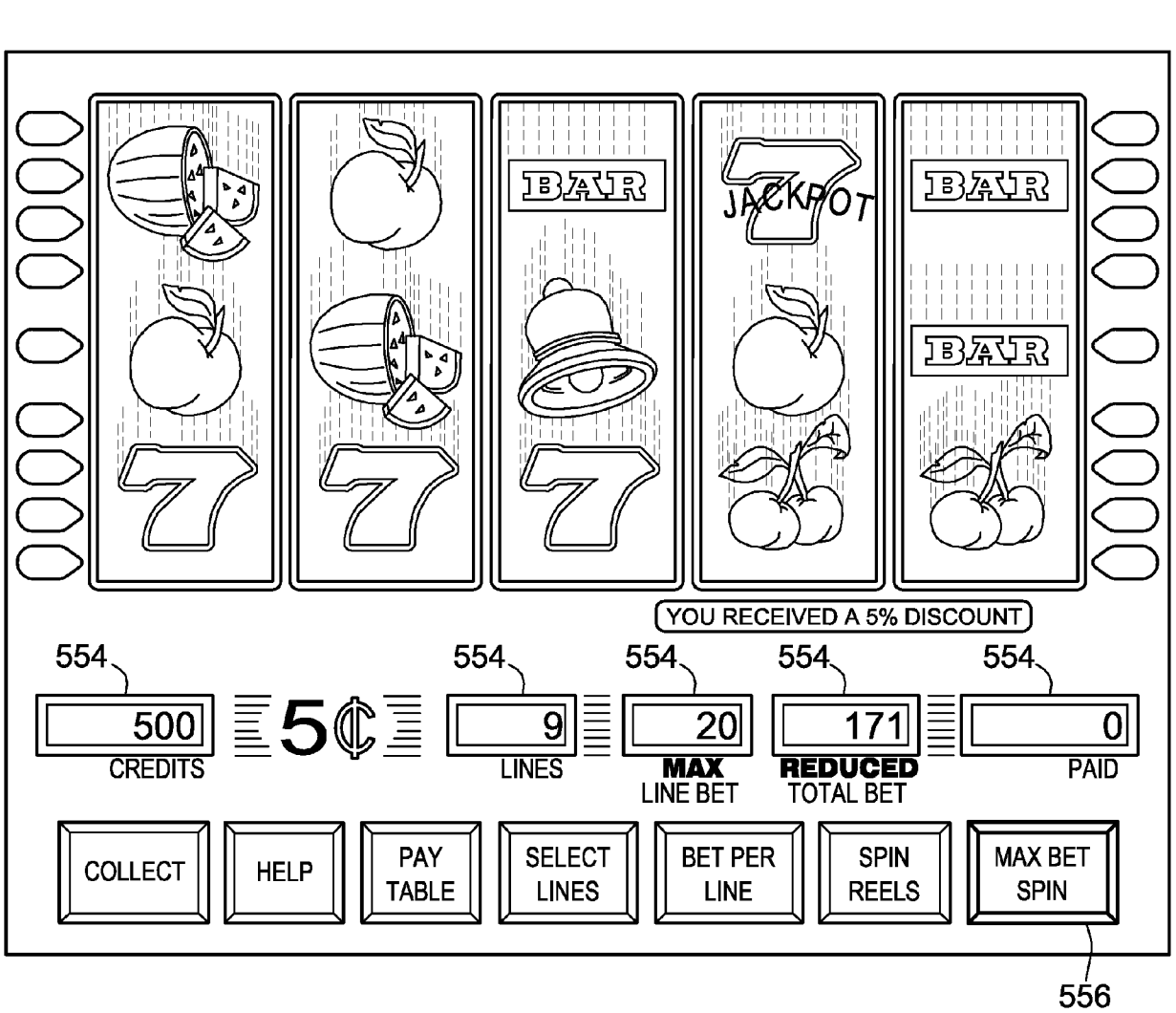
FIG. 5 is an image of an exemplary basic-game screen of a wagering game displayed on a gaming terminal, according to an embodiment of the present invention.

Turning now to FIG. 5, a continuation of the wagering game play from FIG. 4 is illustrated following the selection by the player of the max bet spin button 556 (e.g., element 456 in FIG. 4). In response to the player selecting button 556, the game-session credit meters were modified to indicate that the number of paylines was increased to a maximum number of paylines (e.g., 9) and the line bet was increased to the maximum line bet (e.g., 20). This maximum line, maximum bet combination would normally result in a total bet of 180 credits, for the exemplary aspect illustrated herein. However, because the player accepted the offer 470 for the discounted maximum bet wager by selecting the max spin bet button 456, a reduced or discounted maximum bet wager was processed by the wagering game (e.g., 171 credits or a five percent discount off 180 credits).

It is contemplated that wagering option modifications that provide for a reduced or discounted maximum bet wager in a wagering game would be desirable. For example, one novel aspect of the present disclosure is to offer a player an option or opportunity to place a bet that is less than a maximum wager for a wagering game with the player still receiving a benefit or payout value equal to or as if the full maximum wager had been placed.

Gaming systems can track information about a player, a gaming session, or outcomes of gaming sessions and use the information to offer different wagering options to a player. For example, based on the tracking information, the system may also offer or allow a player a certain number of plays until certain event(s) occur or threshold(s) are exceeded during the gaming session. In response to the occurrence of an event (e.g., mystery trigger) or exceeding a certain threshold (e.g., a predetermined number of successive game plays), it is contemplated in novel aspects of the present disclosure that a player is offered an opportunity to enter a bet that is less than a maximum wager for the wagering game with the player still receiving the benefits or values of placing a bet equal to the maximum wager for the wagering game. For example, if a maximum wager for a wagering game is $2, a player may be offered an opportunity to bet $1.90 or something less than the normal maximum wager while still receiving the value of a $2 maximum wager. The trigger for this offer can vary and may include, for example, a certain event or exceeding a certain threshold, such as playing a predetermined number of rounds of a wagering game, playing at certain wagering levels, playing at a certain time of day, or achieving a certain outcome.

In some aspects, a reduction or discount to the maximum wager amount is caused to be offered to a player in response to a player achieving a certain status, a player's game play history, the results of a current gaming session, or specific game outcomes. The reduction or discount may be for one play, a plurality of plays, for all plays, or for an indeterminate number of plays (e.g., a predetermined period of time, until a particular outcome is received) of a wagering game.

In addition to a reduction or discount to a maximum wager, it is contemplated that novel aspects of the present disclosure include payouts of the wagering game remain constant. Thus, while a player's input wager may change, the payout for a particular win stays the same. Furthermore, to the extent payouts are changed in a wagering game, the change in payout is independent of a player's change in wager. Thus, it is contemplated that payouts of a wagering game are not changed in response to a player accepting an offer to place a bet that is less than a maximum wager.

It is contemplated that a reduced or discounted maximum bet may be a single reduction or a tiered reduction. For example, a first discount might reduce the offered maximum wager bet from $2 to the level of $1.90 with a second reduction reducing the offered maximum wager bet further, such as down to $1.80. It is also contemplated reductions to the maximum wager bet may fluctuate up and down or be randomly determined. For example, the discount might be randomly determined within a certain discounted range, such as between $1.60 and $1.90 for a wagering game having a $2 maximum bet.

In some aspects, a trigger event may be associated with how fast a player is playing. For example, the gaming machine is configured to monitor the rate of play of a wagering game. If a player is playing quickly, the player may be offered a discounted maximum bet but if the player's play slows down (e.g., the player steps away for the gaming machine), the discounted maximum bet may increase or go all the way back to the full or normal maximum bet amount. The monitoring can include processing the change in a player's credits, the number of spins over a predetermined time period, or otherwise.

In some aspects, it is contemplated that an offer of a discounted maximum bet can be for a limited period, such as a predetermined period of time or for a predetermined number of spins. An offer for a discounted maximum bet wager can also be triggered by a player winning a progressive game so as to incentivize the player to continue to play and to do so at higher, but discounted, wager levels.

It is further contemplated that a player may have the option to purchase a reduced maximum bet feature for a period of time or for a predetermined number of spins. Such an aspect can be desirable because it encourages a player to play fast for the purchased period of advantageous play.

In some aspects, a discounted maximum bet wager is available or offered for slots wagering games. The slots game is configured so that the discounted maximum bet wager is applied for each payline or the slots game may be configured to discount only select paylines. In one example, if a slots game includes forty paylines and the maximum bet for each payline is ten credits, the maximum bet for the slots game is 400 credits. A one percent or two percent discount may be offered to the player in response to a triggering event such that the player only needs to bet 396 or 392 credit, yet receives a value based on the maximum bet of 400 credits.

It is also contemplated in some aspects a discounted maximum bet wager is awarded to a player based on an increased number of paylines selected by a player for a wagering game. For example, if one payline is selected, the maximum bet per line is the maximum line bet, such as 40 credits. If two paylines are selected, the exemplary maximum bet per line can remain at 40 credits each for a total of 80 credits. If three paylines are selected, the exemplary maximum bet per line is then decreased or discounted, for example to a total of 100 credits for placing a maximum bet for each selected payline. However, the payout value for the discounted wager remains constant based on a bet of 120 credits. A player may therefore be given the option to place maximum bets and as the number of paylines being played or selected for a wagering game increases, a discounted maximum bet is applied to subsequent selections of paylines. Similar to the other discounted maximum bet aspects described herein, the value or payback percentage for the spin having the discounted bet(s) are based on the full maximum bet amount, not a reduced value.

It is further contemplated that in the above example where the maximum bet amount per line (e.g., at 40 credits) is reduced after the selection of a predetermined number of paylines (e.g., discounted to 100 credits or a 20 credit reduction for the third payline) additional paylines may result in yet further reductions. For example, for the next increment (e.g., selection of a fourth payline) may yield a further reduction off the maximum line bet amount, but the reduction may or may not be linear. For example the total bet for the four paylines may be 130 credits (e.g., 40+40+20+30) for max betting on four paylines. A bet on next payline may yet have a different reduction (e.g., a 30 credit reduction) so that the exemplary total bet is now 140 credits (e.g., 40+40+20+30+10) for the reduced maximum bet on the five paylines. The payout percentage or value of the bets while remain at the same for the spin as if the wagering game received a full maximum bet of 200 credits (e.g., 5 paylines×40 credits).

In some aspects, a modified version of a discounted maximum bet wager is contemplated where a player may be offered an extra payline without an additional wager. A slots game will have a certain number of available paylines (e.g., 9 or 40). In some aspects, if a player has selected less than the maximum number of paylines for the slots game, the player may receive an extra payline without placing an additional maximum bet if a maximum bet is place on a predetermined number (e.g., 9, 19, 39) of paylines. For example, if the maximum bet per payline is 10 credits, a player may be offered the option to receive a discounted maximum bet wager where, for every nine (or 19, or 39) paylines a maximum wager is placed, the player can select a free tenth (or 20th, or 40th) payline for which no wager is required. However, the wagering game will pay the player the value or payout percentage as if the maximum wager had been placed on each payline. So, for the 40 payline wagering game, a spin of the reels allows the player to receive four (or two or one) free paylines in response to placing 36 (or 38 or 39) maximum wager bets on the other 36 (or 38 or 39) paylines.

In some aspects it is contemplated that tracking of play of the wagering game session may be used to trigger an offer of an opportunity to accept a reduced maximum bet. For example, for every ten bets at or above a certain wagering level the wagering game may offer a reduced maximum bet option to a player. Thus, in some aspects, a player does not need to be placing maximum bet wagers to receive the opportunity for the reduced maximum bet. The opportunity may be offered to incentivize a player to maximum bet despite placing minimum bets or betting at some level between the minimum bet and the maximum bet. In response to play continuing and the player maintaining a credit balance during the wagering session, the wagering game may also continue to offer reduced maximum bet opportunities to the player after another predetermined increment or number of plays. The reductions may further increase after continued play. For example, a penny reduction off the maximum bet may be offered for spins eleven through twenty in a slots game and another penny reduction (i.e., a total of a two cent reduction) may be offered for spins twenty-one to thirty, and so on. This embodiment can be desirable because it provides incentive for a player to place maximum bets and it increases play time.

In some aspects an offer for the opportunity of a reduced maximum bet is received from or communicated to a player in response to playing a wagering game for a certain period of time or playing at a certain speed. For example, in response to a player of a slots game causing at least ten reel spins of the wagering game every minute, an opportunity for a reduce maximum bet is offered by the wagering game for one or more subsequent reel spin. Furthermore, in addition to offering or rewarding a player with the opportunity for a reduced maximum bet, it is also contemplated that a player may be offered additional incentives to bet or to continue to bet at higher wager amount(s), albeit a reduced maximum bet wager. Such additional incentives may be, for example, opportunities for a bonus trigger symbol that triggers a separate bonus and that appears only when a player is wagering at the higher wager amount (e.g., the reduced maximum bet). The bonus trigger feature may continue after the opportunity is offered to the player for as long as a maximum bet is continued to be received or a reduced maximum bet.

In some aspects, it is contemplated that a discounted maximum bet is offered where the discount is randomly determined from spin to spin of the reels of a slots game. For example, once a discounted max bet wager is offered, a player may accept the offer and then subsequently be offered additional discounted max bet wagers where the amount of the discount is randomly determined from spin to spin or after a predetermined number of spins. The discounted max bet wager may also be randomly determined within a range of values. Furthermore, as a player continues to bet the maximum bet, the range of values may decrease on the lower end so the player feels that an opportunity for greater bargain(s) are being received by continuing to bet the discounted maximum bet. In addition, it is contemplated that the lower end of the range of value may be decreased in response to a player selecting more paylines on which to place a discounted maximum bet.

In some aspects, it may be desirable to display to a player the discounted maximum bet wager for a subsequent max bet spin before the player selects the max bet spin for the current spin. The opportunity for receiving the offer of the subsequent max bet spin can be made contingent upon the player making the current spin at the discounted maximum bet. This can be an effective feature for incentivizing the player to continue wagering at higher levels particularly if the subsequent discounted maximum bet is lower than the current discounted maximum bet. It can also be desirable for a wagering game to display the discount or saving to a player to let the player know the amount of the perceived bargain they are receiving for betting at the discount maximum bet compared to the non-discounted or full maximum bet amount.

In certain aspects, a discounted maximum bet wager may be offered immediately to entice play of a wagering game. For example, a mobile device having gaming capabilities and also capable of being tracked may transmit or push an offer for a discounted maximum bet wager to the mobile device based on the mobile device location. The player may then have the option to accept the offer and play the wagering game. A player may also receive the offer via text advertising while in the vicinity of a casino or gaming device where the player can accept the offer via the mobile device or by interacting with the gaming device. Alternatively, the player may be able to accept the offer and play the wagering game right on the player's mobile device.

It is also contemplated that an inactive wagering machine may offer discounted maximum bet wagers where the amount of the discount progressively increases to entice play of the wagering game. Thus, the longer the gaming machine remains unoccupied or inactive, the lower the maximum bet wager becomes. In some aspects, a similar discounted maximum bet wager opportunity can be applied to a bank of inactive or low activity wagering games, such as may be present on lower traffic areas of a casino floor.

In some aspects, the discounted or reduced maximum bet is offered as a single reduction to the normal maximum bet wager. It is also contemplated that the discounted or reduced maximum bet may continually change after each spin on a random basis (e.g., 2 percent, 5 percent, 4 percent reductions) or is a tiered reduction that is continually decreased (e.g., 2 percent, 4 percent, 6 percent reductions), all resulting in a discounted maximum bet that is less than the normal maximum bet for the wagering game. The duration of the discount may vary.

It is contemplated that a variety of triggering events or offer triggers may cause the wagering game to display an offer for a discounted maximum bet. For example, a trigger could be based on the number of bets placed at a certain wagering level (e.g., every 50 max bets resulting in next spin being offered the discounted max bet). Certain symbol combinations, such as select winning symbol combinations, may also trigger an offer of a discounted maximum bet. Furthermore, a reduced maximum bet can also be triggered or the amount of the reduction can increase based on the number of paylines that are selected. For example, a player betting a $1 maximum bet wagering game may pay $1 for one payline, $2 for two paylines, and then receive a reduction to a $2.80 wager by selecting a third payline.

It is also contemplated that receiving an award, such as an award based on a winning symbol combination, a bonus, or a progressive win, can be a triggering event. By offering a player a reduced maximum bet for a predetermined number of spins or for a predetermined period of time following the award, the player may be incentivized to increase the wager amount and the operator to recoup some of the payout. This aspect may be particularly desirable following a larger than average payout for the wagering game or for a win of a small progressive jackpot. Other triggers of a discounted maximum bet may include the time of day, such as the morning or afternoon to encourage more activity on a casino floor.

In some aspects, a triggering event for the offer of a discounted maximum bet can be a series of losing spins. For example, after a player experiences sequential spins (e.g., five or more) without winning outcomes, the wagering game can display an offer for a discounted maximum bet on the next spin to maintain a player's interest in the wagering game along with the player having the experience of receiving a bargain. If the spins following the non-winning spins further result in sequential non-winning outcomes the amount of the reduction on the discounted maximum bet may be increased. So, initially, a player may, for example, receive a 5 percent discount after a series of non-winning outcomes. If the player continues play by accepting the offer, yet subsequently continues to have an additional series of non-winning outcomes, a deeper discounted maximum bet can be offered. In some aspects, it is contemplated that a player may not necessarily accept the discounted maximum bet after a first series of non-winning outcomes, but deeper discounts can continue to be extended where non-winning outcomes continue for the player, whether the player has accepted the initial discount or not.

In some aspects, a triggering event for a discounted maximum bet can also include achieving certain point or credit thresholds during play of a wagering game. As discussed in other aspects, the discount can also be tiered. For example, if a player earns a certain number of points of credits over a certain period of time (e.g., 1000 points in a day), the player may be offered a certain discounted maximum bet (e.g., 2 percent reduction from the normal maximum bet). Then, after continued play, whether immediately thereafter or intermittent, the player may be offered a deeper discounted maximum bet of exceeding a higher threshold (e.g., a 4 percent reduction after reaching 2500 points). Furthermore, a player's tier may also be tracked by a casino where a higher tiered player may receive additional or deeper discounts or the threshold triggering event may be lower than for a non-tiered or lower-tiered player.

Figure 6:
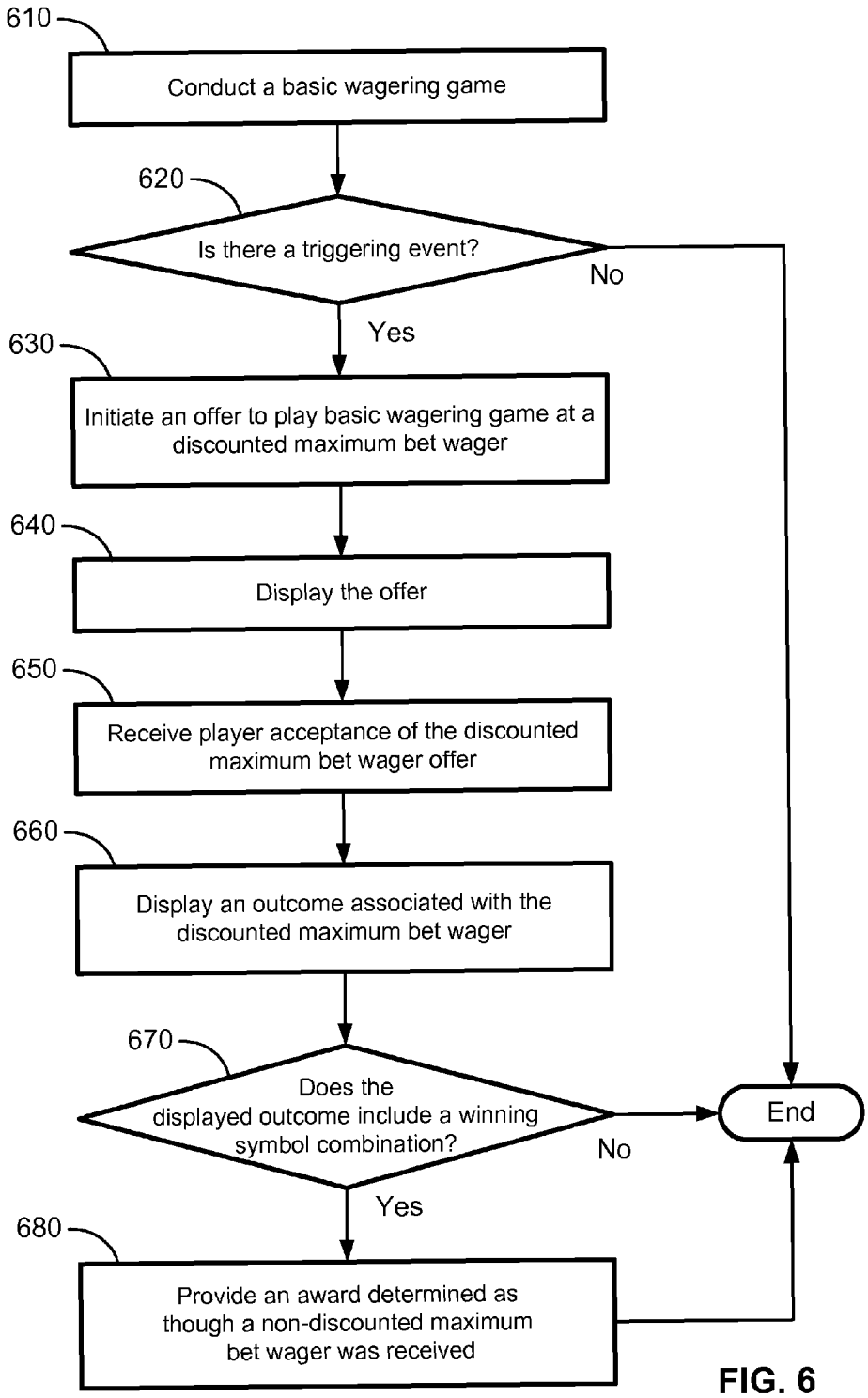
FIG. 6 is a flowchart for an algorithm that corresponds to instructions executed by a controller in accord with at least some aspects of the disclosed concepts.

FIG. 6, described by way of example above, represents one algorithm that corresponds to at least some instructions executed by the CPU 30 in FIG. 2 to perform the above described functions associated with the disclosed concepts. Starting at step 610, a basic wagering game is conducted including a plurality of symbols that indicate a randomly selected outcome of the basic wagering game. Next, in step 620, a determination is made if a triggering event occurs in the basic wagering game or otherwise. In step 630, in response to the occurrence of a triggering event, an offer to play one or more subsequent plays of the basic wagering game is initiated at a discounted maximum bet wager having a wager amount that is less than a non-discounted maximum bet wager. Next, in step 640, the offer is displayed on one or more display devices so, for example, the player can see an offer was made. Then, in step 650, an input indicative of player acceptance of the discounted maximum bet wager offer is received via one or more input devices. Next, in step. 660, a randomly selected outcome from a plurality of possible outcomes is displayed. The plurality of possible outcomes includes a plurality of symbols arranged in an array. At step 670, a determination is made if the displayed outcome includes a winning symbol combination. Then, at step 680, if the displayed randomly selected outcome includes a winning symbol combination, an award is provided for any winning outcome with the provided award being determined as though a non-discounted maximum bet wager was received by the gaming system. A payout value for an award where a discounted maximum wager was placed by a player is equal to a payout value of an award where a non-discounted maximum bet wager was received.

In some aspects, the one or more memory devices can store further instructions, that when executed by at least one of the one or more processors, cause the gaming system to determine a speed of play of the basic wagering game and a triggering event is the speed of play exceeding a predetermined threshold rate. A discounted maximum bet wager can also be discounted or reduced from the non-discounted maximum bet wager for the basic game and the discount determined based on the speed of play of the basic wagering game. It is further contemplated that the one or more memory devices store can further instructions, that when executed by at least one of the one or more processors, cause the gaming system to track the number of maximum bet wagers received during play of the basic wagering game with the triggering event being exceeding a predetermined number of maximum bet wagers.

In some aspects, the triggering event is independent of player-attributable inputs received by the gaming system. The discounted maximum bet wager can also be determined independent of player-attributable inputs received by the gaming system. In addition, the discounted maximum bet wager can be randomly determined, or change after a predetermined number of plays of the basic wagering game. The discounted maximum bet wager may also be available continuously after the input indicative of player acceptance of the discounted maximum bet wager offer is received. Furthermore, the discounted maximum bet wager may linearly decrease after a predetermined number of plays of the basic wagering game.

It is contemplated that a computer-implemented method in a gaming system includes receiving, via at least one of one or more input devices, a first input indicative of a wager. In response to receiving the first input, a basic game is conducted via one or more processors. The basic game includes a plurality of symbols that indicate a randomly selected outcome. In response to an offer trigger, an offer to conduct one or more subsequent plays of the basic game is display on one or more display devices at a reduced maximum bet wager having a wager amount that is less than a normal maximum bet wager amount. A second input indicative of an acceptance of the offer for a reduced maximum bet wager is received via at least one of the one or more input devices. A randomly selected outcome from a plurality of possible outcomes is displayed. The plurality of possible outcomes each includes a plurality of symbols arranged in an array. If the displayed randomly selected outcome includes a winning symbol combination, an award for any winning outcome is provided and the provided award is determined as if a player placed a normal maximum wager. A payout value for an award where a reduced maximum wager was placed is equal to a payout value for an award where a normal maximum bet wager was placed.

In some aspects, a non-linear reduction of the reduced maximum bet wager may be applied after a predetermined number of plays of the basic game. Furthermore, an offer trigger may be achieved that is one of one or more predetermined winning symbol combinations. The offer trigger can be the selecting and wagering on a predetermined number of paylines for each per play of the basic game. The offer trigger can also be determined by the playing frequency of a group of gaming machine.

In some aspects, an offer trigger may be redeeming an offer received based on a location of a gaming machine. The offer can also be based on an outcome of a skilled-based game. A reduced maximum bet wager may be available continuously after a second input indicative of player acceptance of the reduced maximum bet wager offer is received with the maximum bet wager changing after a predetermined number of plays of the basic wagering game. Furthermore, in some aspects, a reduced maximum bet wager linearly decreases after a predetermined number of plays of the basic game.

Each of these embodiments and obvious variations thereof is contemplated as falling within the spirit and scope of the claimed invention, which is set forth in the following claims. Moreover, the present concepts expressly include any and all combinations and subcombinations of the preceding elements and aspects.

What is claimed is:

1. A gaming system, comprising:

a gaming machine primarily dedicated to playing at least one casino wagering game, the gaming machine including an electronic display device and one or more electronic input devices; and one or more controllers configured to:

detect, via at least one of the one or more electronic input devices, a physical item associated with a monetary value that establishes a credit balance, initiate the casino wagering game in response to an input indicative of a wager covered by the credit balance, conduct a basic casino wagering game including a plurality of symbols that indicate a randomly determined outcome of the basic casino wagering game, in response to an occurrence of a triggering event, initiate an offer to play one or more subsequent plays of the basic casino wagering game at a discounted maximum bet wager having a discounted wager amount that is less than a non-discounted maximum bet wager, direct the electronic display device to display the offer, receive, responsive to a physical input to at least one of the one or more electronic input devices, an input indicative of player acceptance of the discounted maximum bet wager offer, in response to receiving the input indicative of player acceptance, deduct only the discounted wager amount from the credit balance displayed on a credit meter, direct the electronic display device to display a randomly selected outcome from a plurality of possible outcomes, the plurality of possible outcomes each including a plurality of symbols arranged in an array, in response to the displayed randomly selected outcome including a winning symbol combination, provide a tangible award for any winning outcome, the provided award increasing the credit balance, the provided award being determined as though a non-discounted maximum bet wager was received, and receive, via at least one of the one or more electronic input devices, a cashout input that initiates a payout from the credit balance.

2. The gaming system of claim 1, wherein the one or more controllers are further configured to cause the gaming system to determine a speed of play of the basic casino wagering game, the triggering event being the speed of play exceeding a predetermined threshold rate.

3. The gaming system of claim 1, wherein the discounted maximum bet wager is discounted from the non-discounted maximum bet wager for the basic casino wagering game, the discount being determined based on the speed of play of the basic casino wagering game.

4. The gaming system of claim 1, wherein the one or more controllers are further configured to cause the gaming system to track the number of maximum bet wagers received during play of the basic casino wagering game, the triggering event being exceeding a predetermined number of maximum bet wagers.

5. The gaming system of claim 1, wherein the triggering event is independent of player-attributable inputs received by the gaming system.

6. The gaming system of claim 1, wherein the discounted maximum bet wager is determined independent of player-attributable inputs received by the gaming system.

7. The gaming system of claim 1, wherein the discounted maximum bet wager is randomly determined.

8. The gaming system of claim 1, wherein the discounted maximum bet wager changes after a predetermined number of plays of the basic casino wagering game.

9. The gaming system of claim 8, wherein the discounted maximum bet wager is available continuously after the input indicative of player acceptance of the discounted maximum bet wager offer is received.

10. The gaming system of claim 1, wherein the discounted maximum bet wager linearly decreases after a predetermined number of plays of the basic casino wagering game.

11. A method of operating a gaming system, the gaming system including one or more controllers and a gaming machine, the gaming machine primarily dedicated to playing at least one casino wagering game, the gaming machine including an electronic display device and one or more electronic input devices, the method comprising:

detecting, via at least one of the one or more electronic input devices, a physical item associated with a monetary value that establishes a credit balance;

initiating, by the one or more controllers, a basic casino wagering game in response to an input indicative of a wager covered by the credit balance, the basic casino wagering game including a plurality of symbols that indicate a randomly selected outcome;

in response to an offer trigger, displaying on the electronic display device an offer to conduct one or more subsequent plays of the basic casino wagering game at a reduced maximum bet wager having a discounted wager amount that is less than a normal maximum bet wager amount;

receiving a second input indicative of an acceptance of the offer for the reduced maximum bet wager;

in response to receiving the second input, reducing, by the one or more controllers, the credit balance by only the discounted wager amount;

determining, by the one or more controllers, a randomly selected outcome of the casino wagering game;

displaying on the electronic display device the randomly selected outcome from a plurality of possible outcomes, the plurality of possible outcomes each including a plurality of symbols arranged in an array;

in response to the displayed randomly selected outcome including a winning symbol combination, providing, by the one or more controllers, a tangible award that increases the credit balance for any winning outcome, the provided award being determined as though a normal maximum bet wager amount was received; and receiving, via at least one of the one or more electronic input devices, a cashout input that initiates a payout from the credit balance.

12. The method of claim 11, wherein a non-linear reduction of the reduced maximum bet wager is applied after a predetermined number of plays of the basic casino wagering game.

13. The method of claim 11, wherein the offer trigger is achieving a one of one or more predetermined winning symbol combinations.

14. The method of claim 11, wherein the offer trigger is selecting and wagering on a predetermined number of paylines for each per play of the basic casino wagering game.

15. The method of claim 11, wherein the offer trigger is determined by the playing frequency of a group of gaming machines.

16. The method of claim 11, wherein the offer trigger is redeeming an offer received based on a location of a gaming machine.

17. The method of claim 11, wherein the offer trigger is based on an outcome of a skilled-based game.

18. The method of claim 11, wherein the reduced maximum bet wager is available continuously after the second input indicative of player acceptance of the reduced maximum bet wager offer is received, the maximum bet wager changing after a predetermined number of plays of the basic casino wagering game.

19. The method of claim 11, wherein the reduced maximum bet wager linearly decreases after a predetermined number of plays of the basic casino wagering game.

20. A casino gaming machine primarily dedicated to playing at least one casino wagering game, comprising:

a gaming cabinet;

an electronic display device coupled to the gaming cabinet;

one or more electronic input devices coupled to the gaming cabinet; and one or more controllers configured to:

detect, via at least one of the one or more electronic input devices, a physical item associated with a monetary value that establishes a credit balance, conduct a basic wagering game including a plurality of symbols that indicate a randomly selected outcome of the basic wagering game, the basic wagering game being initiated in response to the electronic data signal from at least one of the one or more electronic input devices, in response to an occurrence of a triggering event, initiate an offer to play one or more subsequent plays of the basic wagering game at a discounted maximum bet wager;

direct the electronic display device to display the offer, receive, via at least one of the one or more electronic input devices, an input indicative of an acceptance of the discounted maximum bet wager offer, the discounted maximum bet wager having a value of a non-discounted maximum bet wager, in response to receiving the input indicative of the acceptance, deducting only the discounted maximum bet wager from the credit balance displayed by the gaming machine, direct the electronic display device to display a randomly selected outcome from a plurality of possible outcomes, the plurality of possible outcomes each including a plurality of symbols arranged in an array, in response to the displayed randomly selected outcome including a winning symbol combination, provide a tangible award that increases the credit balance for any winning outcome, the provided award being determined as though a non-discounted maximum bet wager amount was received, and receive, via the at least one of the one or more electronic input devices, a cashout input that initiates a payout from the credit balance.

* * * * *